US007111367B2

(12) United States Patent
Keyaki et al.

(10) Patent No.: US 7,111,367 B2
(45) Date of Patent: Sep. 26, 2006

(54) SLIDER FOR A CONCEALED SLIDE FASTENER

(75) Inventors: Keiichi Keyaki, Toyama-ken (JP); Kenji Yuki, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/663,753

(22) Filed: Sep. 17, 2003

(65) Prior Publication Data

US 2004/0055119 A1 Mar. 25, 2004

(30) Foreign Application Priority Data

Sep. 20, 2002 (JP) ..... 2002-274333

(51) Int. Cl.
*A44B 19/26* (2006.01)

(52) U.S. Cl. ..... 24/427; 24/381

(58) Field of Classification Search ..... 24/432, 24/415–431

See application file for complete search history.

(56) References Cited

U.S. PATENT DOCUMENTS

| | | | | |
|---|---|---|---|---|
| 2,312,284 A | | 2/1943 | Schaaff | |
| 3,696,472 A | * | 10/1972 | Perina et al. | 24/406 |
| 3,854,175 A | * | 12/1974 | Yoshida | 24/427 |
| 4,071,928 A | | 2/1978 | Oda | |
| 4,409,705 A | * | 10/1983 | Yuunaga | 24/415 |
| 4,562,622 A | | 1/1986 | Takabatake | |
| 5,956,819 A | * | 9/1999 | Terasaki et al. | 24/432 |
| 6,112,376 A | * | 9/2000 | Akashi et al. | 24/432 |
| 6,497,016 B1 | * | 12/2002 | Lin | 24/418 |
| 6,530,132 B1 | * | 3/2003 | Yamagishi et al. | 24/427 |

FOREIGN PATENT DOCUMENTS

| | | |
|---|---|---|
| FR | 790 635 A | 11/1935 |
| GB | 1 467 685 | 3/1977 |
| JP | 46-6574 | 3/1971 |
| JP | 56-22729 | 5/1981 |

OTHER PUBLICATIONS

European Search Report dated Jul. 15, 2004 for Application No. EP 03 01 9855.

* cited by examiner

*Primary Examiner*—Jack W. Lavinder
(74) *Attorney, Agent, or Firm*—Finnegan, Henderson, Farabow, Garrett & Dunner LLP

(57) ABSTRACT

This invention relates to a concealed-type slider. Side walls are erected on both sides of a bottom plate of a body and a top end of each side wall is bent to form a flange. A guide portion is provided by forming a down-grade slope inclined from a leading end of a shoulder opening side of the flange between the flange and the side wall. The leading end of the flange provided with this guide portion is disposed at right angle to or tilted more or less toward a rear mouth side with respect to a side face of a guide post. Consequently, when an insert pin is inserted, the guide portion guides a fastener tape smoothly and when sliding the slider in its closing direction, the sliding operation can be executed smoothly.

1 Claim, 10 Drawing Sheets

SLIDER FOR A CONCEALED SLIDE FASTENER

BACKGROUND OF THE INVENTION

1. Field of the Invention

The invention relates to a slider for a concealed slide fastener. More particularly, the invention is relates to a slider for a closed product, namely, a concealed slide fastener in which an end of a fastener chain is closed with a stop and a slider for an openable product, namely, an open-type concealed slide fastener provided with a releasable bottom end stop at an end of a fastener chain.

2. Description of the Related Art

In a slider for a conventional concealed slide fastener disclosed in, for example, Japanese Utility Model Publication No. 46-6574, side wall portions 114 are erected on both sides of a bottom plate 113 and by bending a top end of each side wall portion 114 inwardly, a top piece portion 115 for guiding fastener elements is provided, as shown in FIG. 14. Then, a front end portion of the side wall portion 114 is tilted and an inner leading end of the top piece portion 115 is projected to a shoulder opening 143 side so as to provide a protrusion 151.

Further, in a slider for a conventional concealed slide fastener disclosed in, for example, Japanese Utility Model Publication No. 56-22729, side plates 214 are erected on both sides of a substrate 213 and a top end of each side plate 214 is bent inwardly so as to provide a top face plate 215 for guiding fastener elements, as shown in FIG. 15. Then, a leading end of the top face plate 215 is located on a rear mouth 244 side with respect to a leading end of the substrate 213 and a leading end portion of the side plate 214 is cut out in a U shape so as to provide an opening 252 between the top face plate 215 and the substrate 213.

In the concealed-type slider disclosed in the Japanese Utility Model Publication No. 46-6574, because the leading end of the top piece portion 115, provided by bending the top end of the side wall portion 114 inwardly, is provided with the protrusion 151 projecting to the shoulder opening 143 side of the slider, the protrusion 151 makes a sliding contact with a fastener tape attached to the fastener elements in an inverted state when sliding the slider, thereby producing a large sliding resistance, so that a smooth sliding operation cannot be attained. If the conventional concealed-type slider is used in the openable product as a releasable-type slider, when an insert pin is inserted into the slider, an end portion of the fastener tape is caught by the protrusion 151 or abuts the protrusion 151, so that a smooth insertion operation cannot be performed.

In the concealed-type slider disclosed in the Japanese Utility Model Publication No. 56-22729 also, the opening 252 is formed by cutting out the leading end of the side plate 214 in the U shape so that the leading end of the top face plate 215 is projected to a shoulder opening 243 side of the slider thereby forming a projecting portion 251. Therefore, when sliding the slider, this projecting portion 251, which projects from the side plate 214, makes a sliding contact with the fastener tape attached to the fastener elements in the inverted state, thereby increasing the sliding resistance and blocking a smooth sliding operation. Further, if this slider is employed as the releasable-type slider, when the insert pin is inserted into the slider, the end portion of the fastener tape is caught by the projecting portion 251 or abuts the projecting portion 251 thereby blocking a smooth insertion operation.

The invention has been achieved in views of the above-described problems and a main object of the invention is to provide a slider for a concealed slide fastener which, when the slider for the concealed slide fastener is employed as both of a fastener chain for a closed product and a fastener chain for an openable product, is capable of sliding smoothly between fastener tapes attached to fastener elements in an inverted state, that is, in a U shape. In a case that the slider is used in the openable product, when an insert pin of a reliable bottom stop end attached to an end portion of the fastener chain is inserted into a box after it is inserted into the slider, an end portion of the fastener tape having the insert pin is not obstructed by a flange and can be inserted smoothly under a guide by the slider.

Another object of the invention is to provide a slider for a concealed slide fastener, in which the sliding operation of the concealed slider and insertion operation of the insert pin can be executed smoothly and effectively, and when the slider is slid by a pulling operation with a pull, sliding resistance which the flange of the slider gives to the fastener chain is minimized so as to attain a smooth sliding.

Still another object of the invention is to provide a slider for a concealed slide fastener which is very similar to an ordinary slide fastener for the openable product, achieves the same easy engagement/disengagement operation as the ordinary openable product by the users and attains safety in usage, although it is the concealed slide fastener.

SUMMARY OF THE INVENTION

To achieve the above-described objects, in a concealed-type slider according to the invention, side walls are erected on both sides of a bottom plate, a top end of each side wall is bent toward an inside of a body so as to provide a flange, and a down-grade slope inclined from a leading end of the flange located on a shoulder opening side of the body is provided between the flange and the side wall.

Preferably, the down-grade slope inclined from a leading end of the flange located on a shoulder opening side of the body is provided between the flange and the side wall, and the slope allows an end portion of a fastener tape, to which an insert pin is attached, to slide along the slope and guides the end portion.

Preferably, the leading end of the flange on the shoulder opening side is disposed at right angle to or tilted toward a rear mouth side with respect to a side face of a guide post of the body. A starting point of the slope in the flange is preferred to be located at a position where a mounting shaft of a pull attached to the guide post of the body is supported pivotally. Preferably, the slope is so formed that its longitudinal sectional shape at the side wall is linear or curved. Further, it is permissible to dispose a covering plate substantially equal to the contour of the plan view of the body above the flange of the concealed-type slider with a predetermined interval to the flange.

DESCRIPTION OF THE PREFERRED EMBODIMENTS

Hereinafter, the preferred embodiments of a slider for a concealed slide fastener of the invention will be described in detail with reference to the accompanying drawings.

Figure 1:
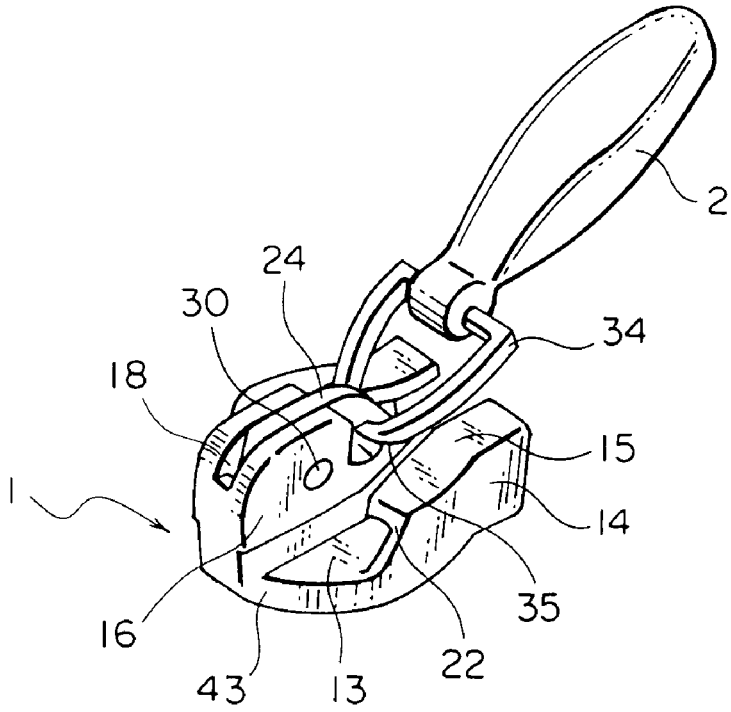
FIG. 1 is a perspective view of a concealed-type slider according to a first embodiment.
Figure 2:
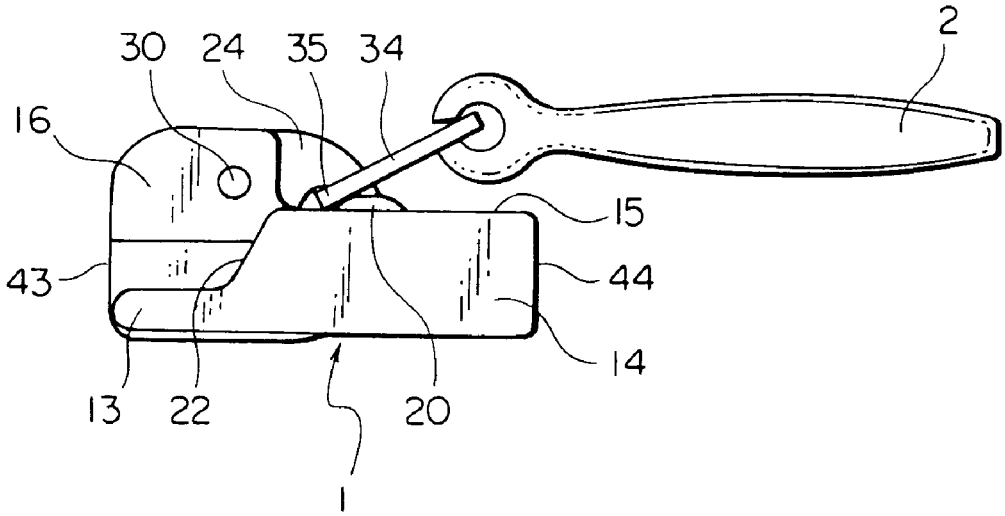
FIG. 2 is a side view of the same slider.

The slider for the concealed slide fastener according to the first embodiment of the invention, which is shown in FIG. 1, has an automatic stop mechanism and its body 1 is formed of metal such as zinc alloy, aluminum alloy by die-cast molding. Side walls 14 are erected on both sides of a bottom plate 13 and by bending top ends of the side walls 14 inwardly, flanges 15 are formed. A guide post 16 is provided in the center of the bottom plate 13 and a gap S is provided between the guide post 16 and each flange 15 and between the both flanges 15 for the fastener tape 5 to pass through. A guide groove 17, which allows fastener elements 6 mounted a side edge of the fastener tape 5 bent in a U shape to pass through and be guided, is provided in a portion surrounded by the guide post 16 and each side wall 14 and the flanges 15.

Figure 3:
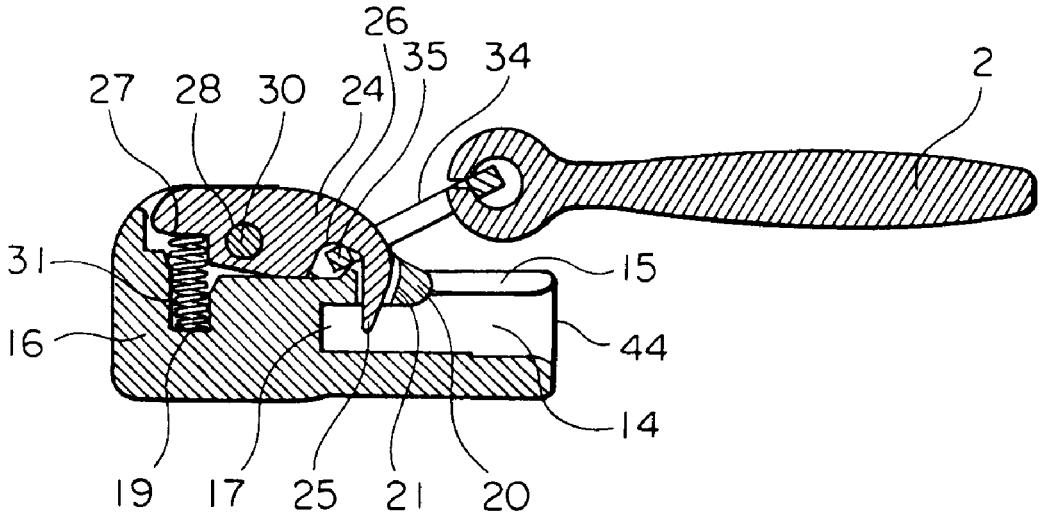
FIG. 3 is a longitudinal sectional view of the same slider.

A concave groove portion 18, which is concaved in a longitudinal direction, is provided in a top portion of the guide post 16. As shown in FIG. 3, a hook-shaped pawl lever 24 having a locking pawl 25 at an end thereof is loosely fit to this concave groove portion 18 and a supporting shaft 30 is inserted into a shaft hole 28 provided in the center of the pawl lever so as to fix the pawl lever such that the pawl lever 24 is rotatable. A concave catching portion 26 is provided in a proximal portion of the locking pawl 25 provided at an end of the pawl lever 24 and a mounting shaft 35 formed on an end of a triangular clamper 34 which is coupled with the pull 2, is engaged with the catching portion 26. A cut-out pressing portion 27 is provided on the other end of the pawl lever 24 and a cylindrical accommodating hole 19 is provided below the concave groove portion 18 in the guide post 16 so that a spring 31 is accommodated therein. A top end of the spring 31 makes a pressure contact with the pressing portion 27 so that the locking pawl 25 is capable of freely advancing/retracting through a pawl hole 21 formed in a projecting piece 20 provided so as to extend from a leading end of a rear mouth 44 side of the guide post 16, thereby automatically stopping the sliding of the slider.

The structure considered as the most important aspect by the invention in the concealed-type slider formed in this way is that the side walls 14 are erected on both sides of the bottom plate 13 and the guide portion 22 for guiding the fastener tape 5 is formed on a shoulder opening 43 side of the flange 15, which is provided by bending the top end of the side wall 14. The guide portion 22 is preferably disposed in the vicinity of mounting shaft 35 of the clamper 34 mounted on the guide post 16, that is, between the mounting shaft 35 and the supporting shaft 30. In the guide portion, a slope having a longitudinal section that is a linear downgrade shape toward the shoulder opening 43 side is formed from the flange 15 to the side wall 14. The leading end of the guide portion 22 is disposed at right angle to or slightly tilted toward the rear mouth 44 with respect to a side face of the guide post 16.

Figure 4:
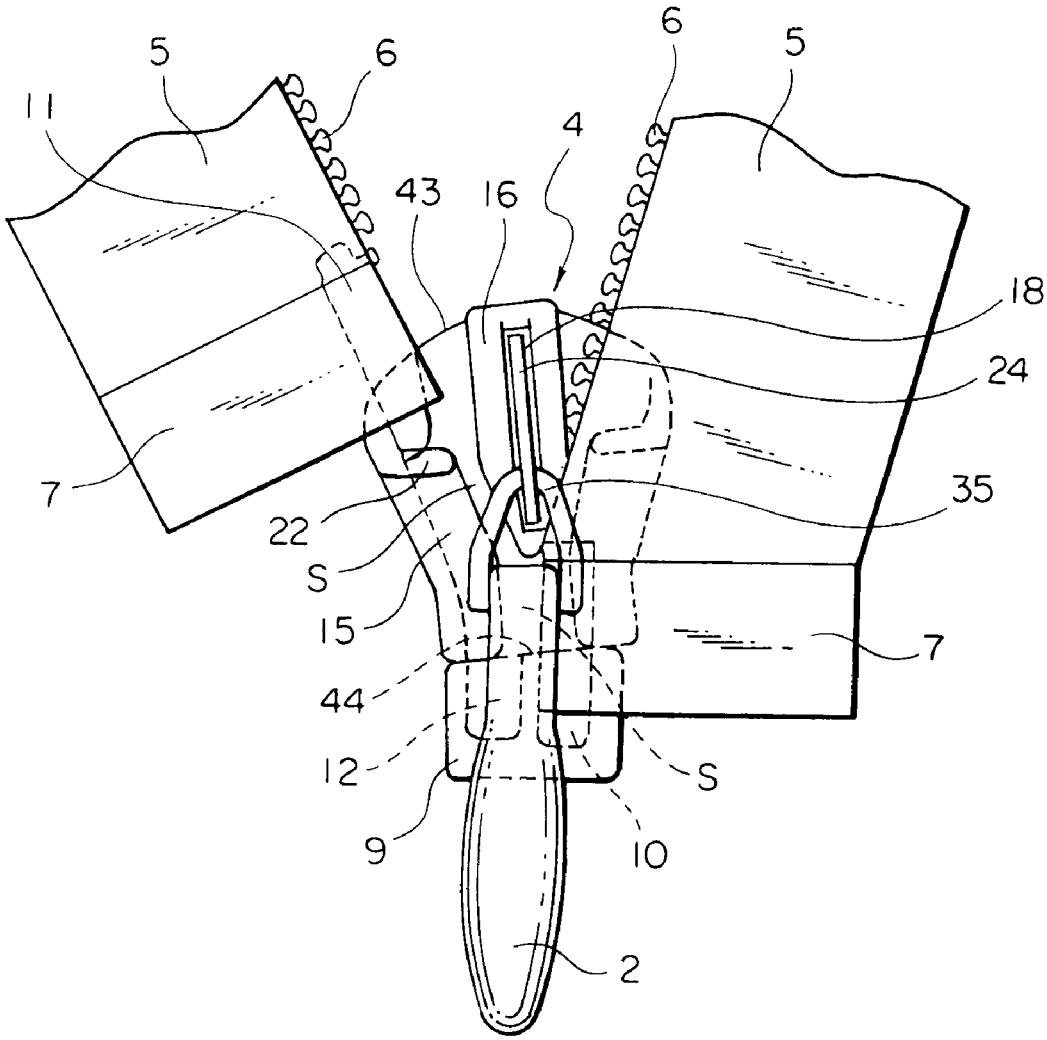
FIG. 4 is a front view of a fastener chain with a releasable bottom end stop having the same slider.
Figure 5:
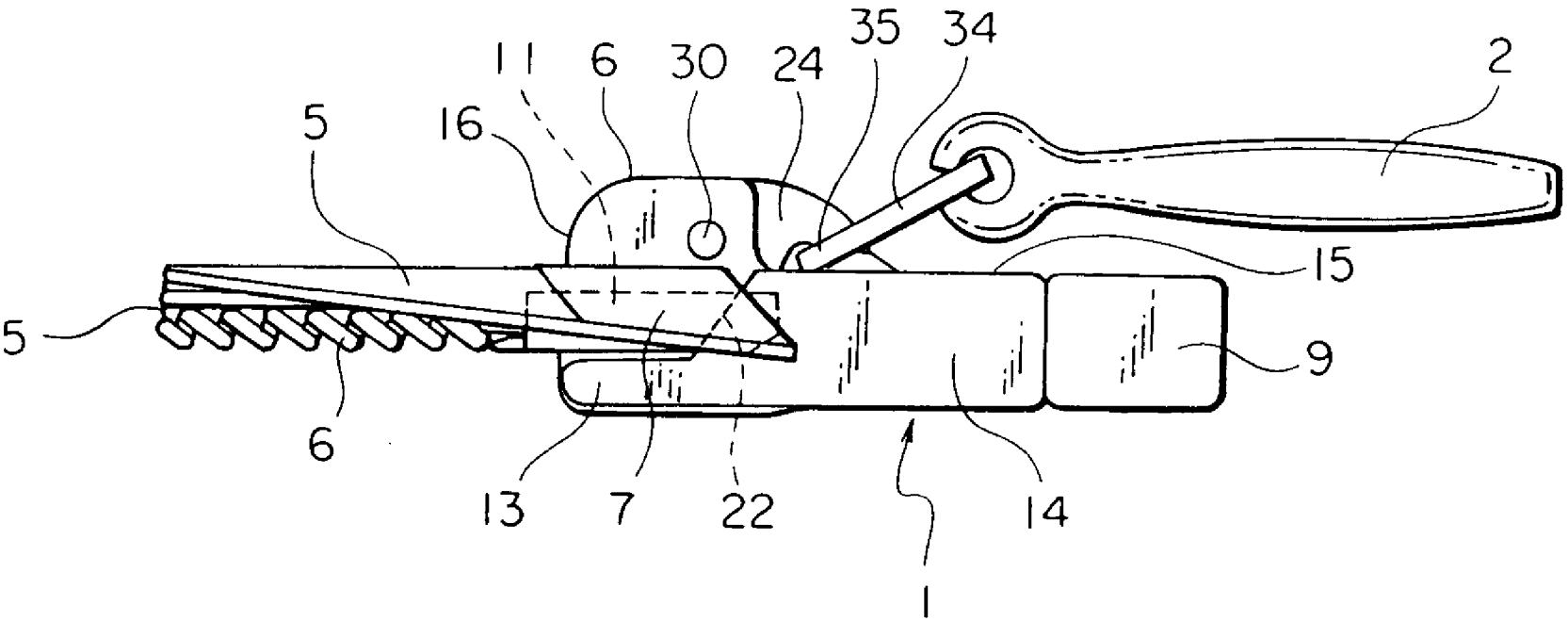
FIG. 5 is a side view of the fastener chain with the releasable bottom end stop having the same slider in FIG. 4.
Figure 6:
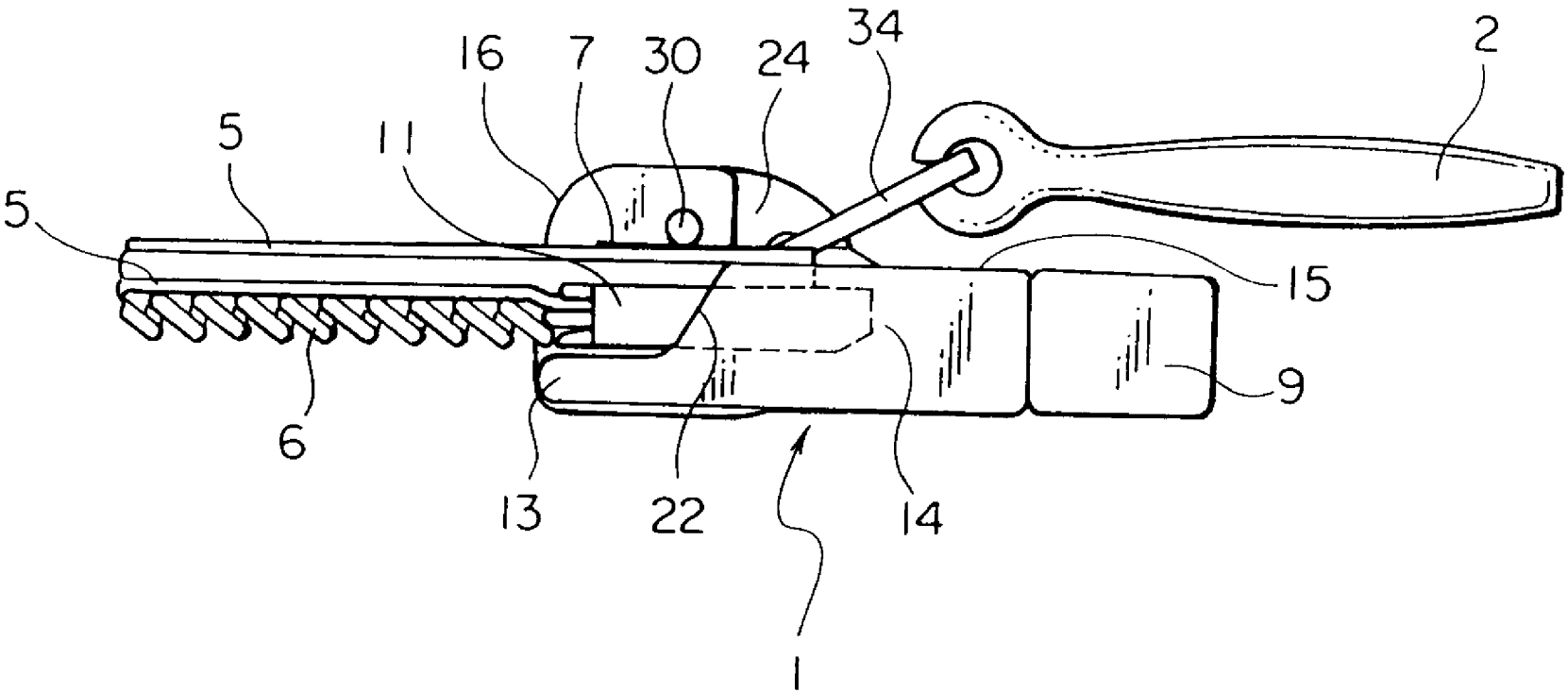
FIG. 6 is a side view showing an insertion state in which an insert pin is inserted into the slider, in the fastener chain with the releasable bottom end stop having the same-slider.

As shown in FIGS. 4–7, when the insert pin 11 of the releasable bottom end stop 8 disposed on an end portion of the fastener chain 4 is inserted into the box 9, after the insert pin 11 mounted on a side edge of a reinforcement tape 7 fixed on the end portion of one fastener tape 5 is inserted into the guide groove 17 formed in the body 1 of the slider, as shown in FIGS. 4 and 5, a leading end of the fastener tape 5 slides along the guide portion 22 as the slope provided on the side wall 14 of the slider and then is introduced to the guide portion 22 provided at the leading end of the flange 15 as shown in FIG. 5. When the insert pin 11 is advanced into the inside of the guide groove 17 as shown in FIG. 6, the leading end of the U-shaped bent fastener tape 5 is introduced along the guide portion and then, it is inserted into a gap S provided between the flange 15 and the guide post 16 formed on the slider. When the insert pin 11 is advanced further into the inside, the leading end of the U-shaped bent fastener tape 5 is guided into the gap S provided between the opposing flanges 15 formed on the rear mouth 44 side of the guide post 16 formed on the slider.

Figure 7:
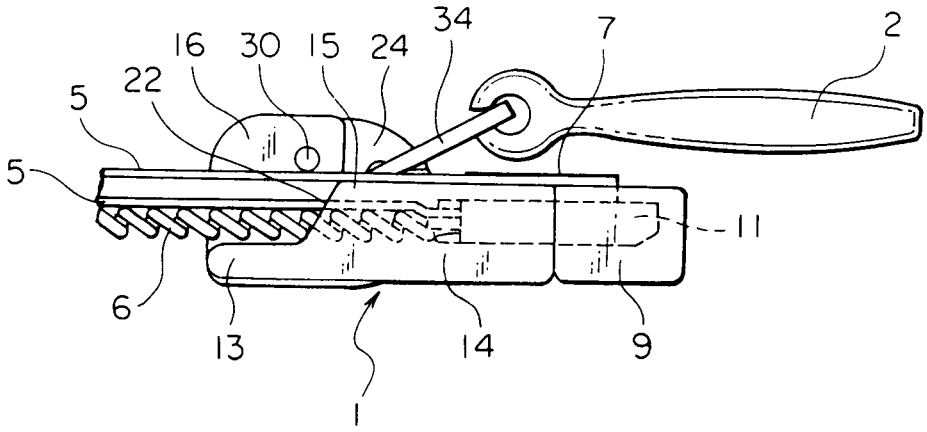
FIG. 7 is a side view showing an insertion state in which the insert pin is inserted into a box, in the fastener chain with the releasable bottom end stop having the same slider.

If the insert pin 11 is further advanced into an inner part of the guide groove 17, it comes into contact with the slider and then invades into the box 9 of the releasable bottom end stop 8 attached to the end portion of the fastener tape 5. Consequently, as shown in FIG. 7, the insert pin 11 is inserted into an insert pin insertion portion 12 in the box 9 and fixed therein. By sliding the slider in the direction to the shoulder opening 43 under the above condition, the fastener chain 4 can be closed.

In this sequential operation, for example, inserting operation of the insert pin attached to the fastener tape into the box, the end portion of the fastener tape 5 can be guided smoothly and inserted or fitted easily, because there is no protrusion on the guide portion 22 of the slope provided on the side wall 14 and the flange 15 of the body 1. Further, in opening/closing operation of the fastener chain 4, because there is no protrusion projecting from the guide portion 22 toward the shoulder opening 43 side at each side of the guide post 16 of the body 1, friction resistance generated when sliding the slider is small, thereby securing a smooth sliding operation. This slider can be applied to not only an openable product but also a closed product. In addition, it is preferable that the guide portion 22 is a slope inclined in a range of 40° to 70° with respect to the bottom portion 13.

Meanwhile, forming a top face of the box 9 of the releasable bottom end stop 8 attached to the end portion of the fastener tape 5 in a sloped-shape allows the slider to be placed obliquely when the rear mouth 44 of the slider comes into contact with the box 9, so that the insertion operation of the insert pin 11 can be attained smoothly and easily. Further, because the concave groove portion 18 provided in the top portion of the guide post 16 is deflected, the locking pawl 25 of the pawl lever 24 mounted thereon can be inserted between fastener elements 6 at a side in which the box pin 10 is attached.

Figure 8:
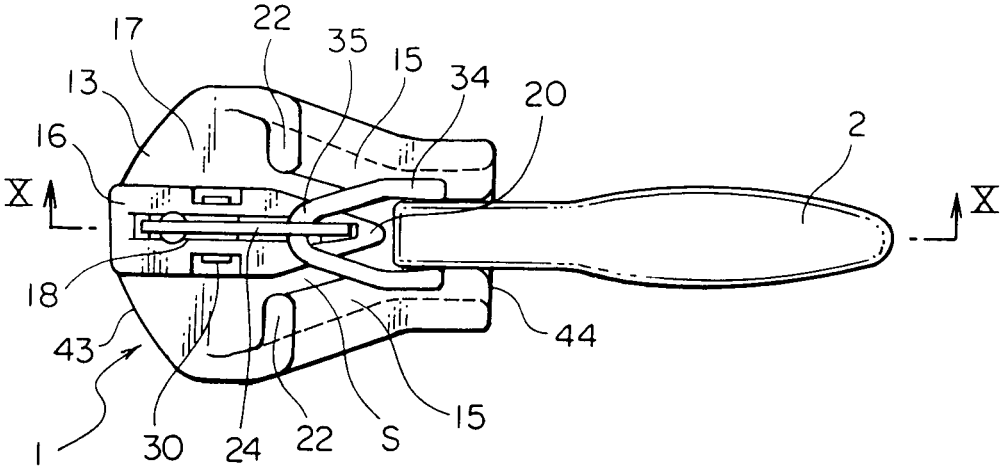
FIG. 8 is a front view of a concealed-type slider according to a second embodiment.
Figure 9:
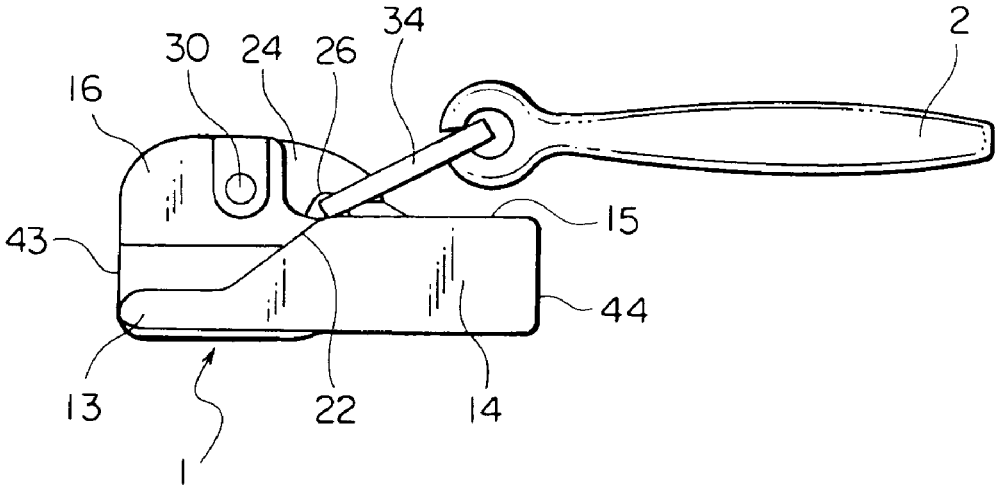
FIG. 9 is a side view of the same slider.
Figure 10:
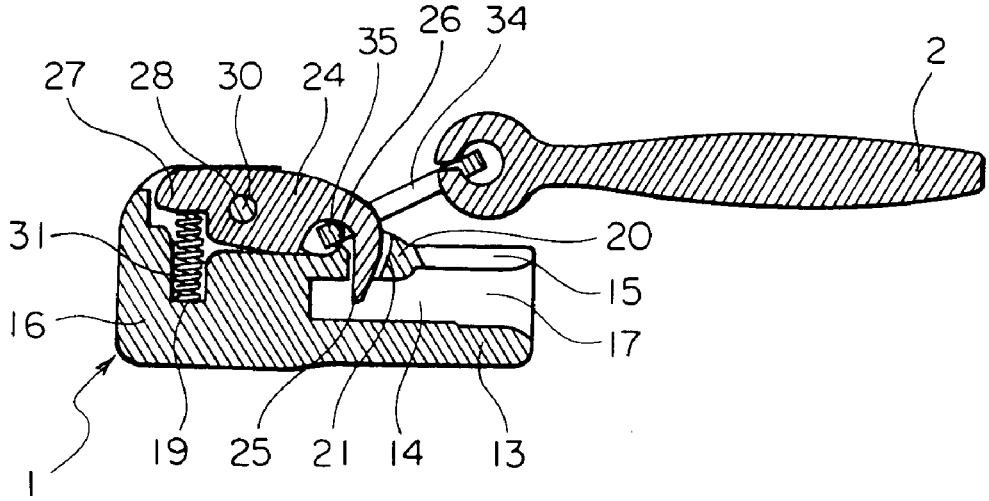
FIG. 10 is a sectional view taken along the lines X—X of FIG. 8.

The concealed-type slider of the second embodiment shown in FIGS. 8–10 has substantially the same structure except that the configuration of the guide portions 22 of the slope formed on of the side walls 14 erected on both sides of the bottom plate 13 of the body 1 and the flanges 15 provided by bending the top ends of the side walls 14 inwardly is more or less different from the previous embodiment. As shown in FIGS. 8 and 9, the guide portion 22 is so provided that a starting point of the guide portion 22 is determined with respect to the mounting shaft 35 of the clamper 34, which connects the pull 2 to the body 1 by the clamper 34.

Because the starting point of the guide portion 22 is provided with respect to the mounting shaft 35 for the pull 2, when the insert pin 11 attached to one fastener tape 5 is inserted into the guide groove 17 of the slider upon closing the fastener chain 4, the insertion operation can be carried out smoothly like the previous embodiment. When the fastener chain 4 is closed by sliding the slider after the insert pin 11 is inserted into the box 9, if there is produced an obstacle at the shoulder opening 43 side of the body 1, for example, the leading end of the flange 15 is projected as a result of pulling the pull 2, that obstacle rubs an inner face of the fastener tape 5 bent in a U shape and therefore, a large sliding resistance is felt. However, according to the invention, the flange 15 is not projected from the mounting shaft 35 to the shoulder opening 43 side and therefore, the friction resistance is so small that a smooth operation can be carried out.

Figure 11:
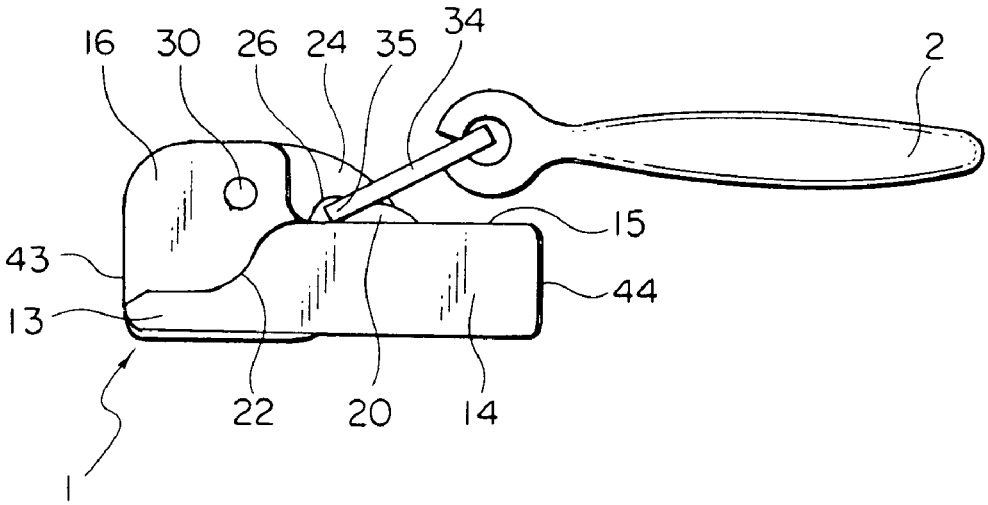
FIG. 11 is a side view of a concealed-type slider indicating a modification of a side portion thereof.

FIG. 11 shows a modification example of the guide portion 22. In this concealed-type slider, the guiding portion 22 of the slope formed from the flange 15 to the side wall 14 of the body 1 extends from the vicinity of the mounting shaft 35 of the clamper 34 for the pull 2 attached to the body 1 toward the shoulder opening 43 side of the body 1 and has a longitudinal section that is a down-grade shape, while the shape of longitudinal section is not linear but curved, for example, with a gradual S-shaped curve, which is different from the previous embodiments. Further, a contact point with the bottom plate 13 of the guide portion 22 and corner portion at the flange 15 are formed with curved faces, respectively. Consequently, the contact with the fastener tape 5 is softened, so that the insertion operation of the insert pin 11 and the sliding operation of the slider can be carried out smoothly.

Figure 12:
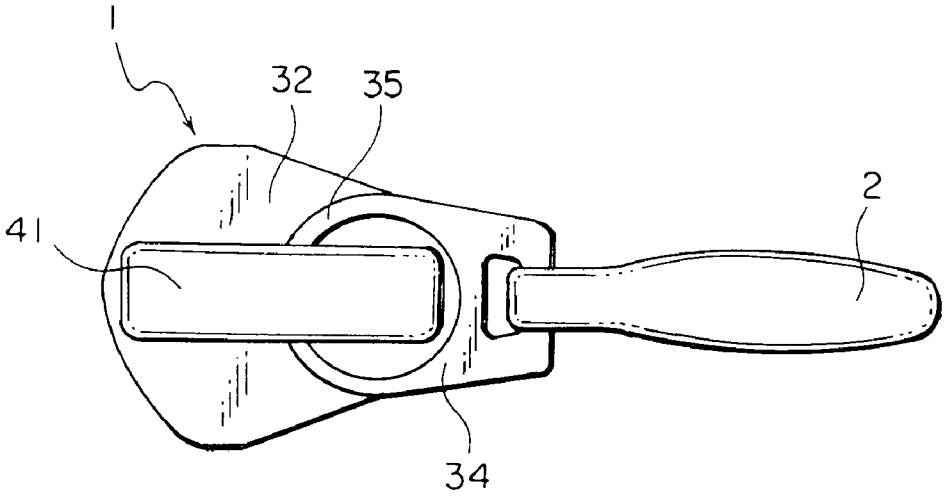
FIG. 12 is a front view of a concealed-type slider according to a third embodiment.
Figure 13:
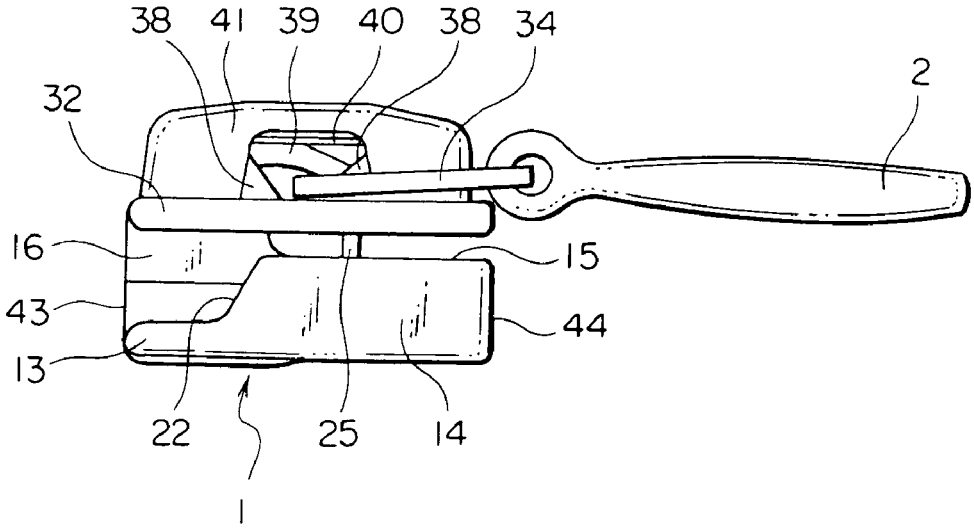
FIG. 13 is a side view of the same slider.
Figure 14:
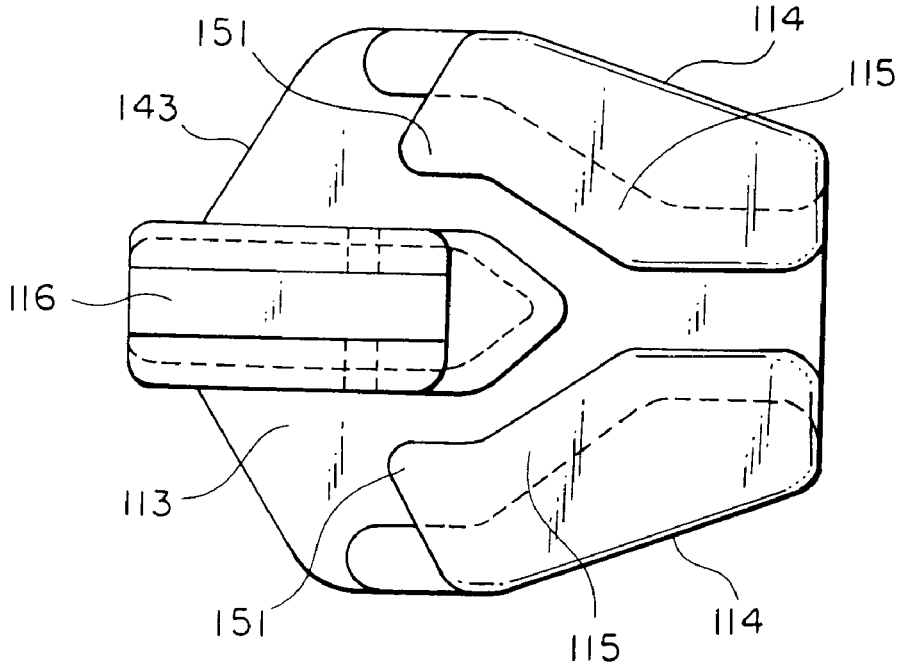
FIG. 14 PRIOR ART
FIG. 14 is a front view of a well-known concealed slider.
Figure 15:
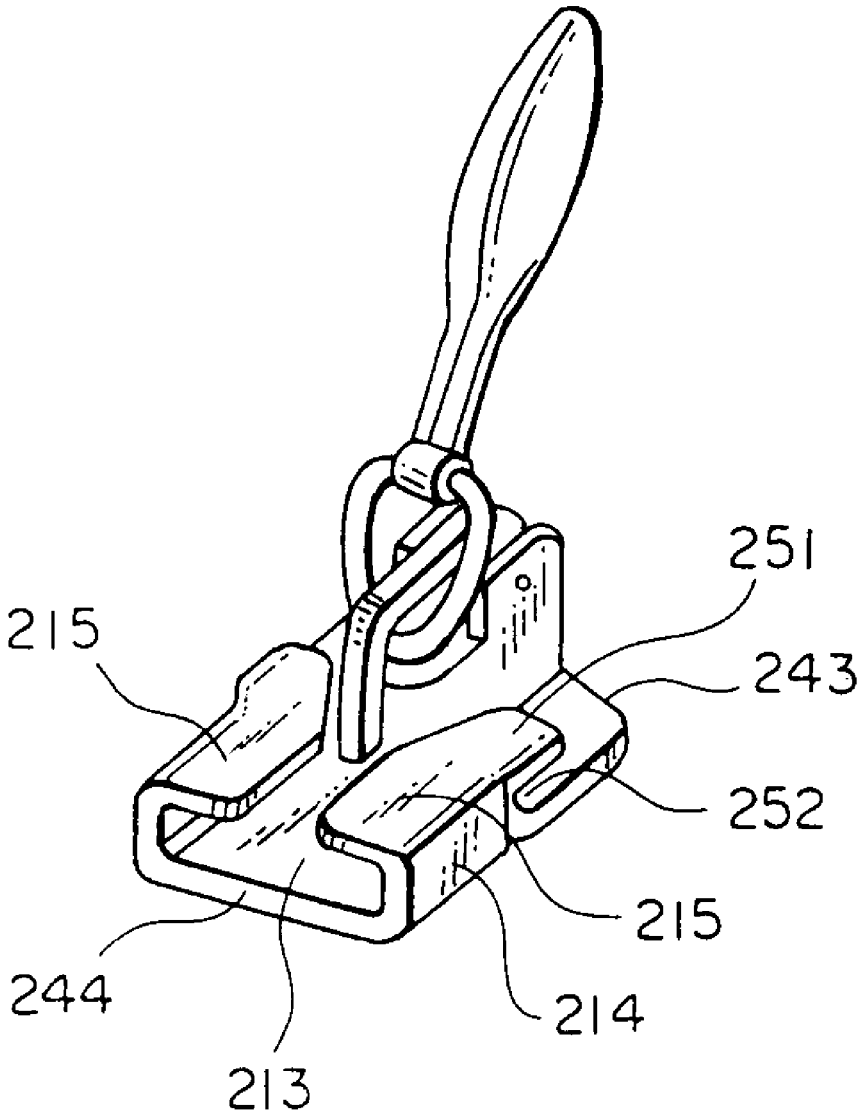
FIG. 15 PRIOR ART
FIG. 15 is a perspective view of other well-known concealed slider.

In the concealed-type slider of the third embodiment shown in FIGS. 12 and 13, its lower half structure of the body 1 is the same as that of the first embodiment, but its upper half structure is different. That is, a covering plate 32 having a substantially equal contour to the plan of the body 1 is mounted on the guide post 16 above the flange 15 with a predetermined interval, so that it is very similar to an ordinary slider for an openable product.

Speaking in detail, triangular mounting columns 38 are disposed on front and rear portions of a surface of the covering plate 32 such that their inclined faces oppose each other. These mounting columns 38 have a gap portion at a center thereof in the longitudinal direction. An inverted-V shaped pawl lever 39 having a locking pawl 25 at one end thereof is interposed in this gap portion and then, a leaf spring 40 is placed above the pawl lever 39 and the center of the pawl lever 39 is urged downward, thereby securing automatic stop function. The mounting shaft 35 of the clamper 34 which is connected to the pull 2 is inserted between the triangular mounting columns 38. When the pull 2 is pulled, the triangular mounting columns 38 act as a cam, so that the pawl lever 39 is pushed up resisting the leaf spring 40, thereby allowing the locking pawl 25 to escape from between the fastener elements 6 and the slider to slide. In the meantime, a ship bottom shaped cover is coated above the leaf spring 40 and then its side face is caulked on the mounting column 38.

This concealed slider is operated in the same procedure as in the previous embodiments. For example, as shown in FIG. 13, the insert pin 11 attached to a U-shaped bent fastener tape 5 is inserted from the shoulder opening 43 into the guide groove 17 and then, the fastener tape 5 is guided into the guide portion 22 of the slope. The insert pin 11 is passed through the gap S disposed on side edge of the flange 15 between the flange 15 and the covering plate 32 and inserted into the insert pin insertion portion 12 of the box 9 and fixed therein. Then, by sliding the slider, the fastener chain 4 is closed. Because the covering plate 32 exists when the insert pin 11 is inserted, the same insertion operation as in the ordinary type openable product can be carried out.

As described above, the concealed-type slider of the invention can be employed for not only an openable type product, for example, the concealed slide fastener having the releasable bottom stop end 8 at an end thereof but also a closed product, for example, the concealed slide fastener in which the end portion of the fastener chain 4 is fixed with a bottom stop.

In the slider for the concealed slider fastener of the invention in which side walls 14 are erected on both sides of the bottom plate 13 and flanges 15 are provided by bending top ends of the side walls 14 inwardly, the down-grade slope inclined from the leading end of the shoulder opening 43 side of the flange 15 is provided between the flange 15 and the side wall 14 so as to form the guide portion 22, or the down-grade slope inclined from the leading end of the shoulder opening 43 side of the flange 15 is provided between the flange 15 and the side wall 14 in the guide groove 17 on the insertion side of the insert pin so as to form the guide portion 22. Consequently, following effects are produced.

The concealed-type slider of the invention can be applied to not only the closed product, namely, the slide fastener in which the end portion of the concealed fastener chain 4 is fixed with the bottom stop but also the openable product, namely, the slide fastener having the releasable bottom end stop 8 at the end portion of the concealed fastener chain 4. The concealed-type slider can be slid smoothly, when the pull 2 of the slider is pulled and moved in a closing direction in order to close the fastener chain 4, because of the guide portion 22 provided on front faces of the flange 15 and side wall 14, and particularly because no flange 15 exists on the front face of the side wall 14 unlike a conventional product, the sliding resistance is small and therefore a smooth sliding can be secured.

Further, in case of the openable product, when the insert pin 11 attached to the fastener tape 5 is inserted into the slider and box 9, the U-shaped bent fastener tape 5 can be inserted smoothly into the box 9 because there exists no protrusion on the front face of the guide portion 22 in the flange 15 of the slider.

Further, because the leading end of the flange 15 is disposed at right angle to or slightly tilted toward the side face of the guide post 16, a corner portion of the guide portion 22 of the flange 15 comes a sliding contact with the fastener tape 5 later than the guide portion of the side wall 14 side, thereby guiding the fastener tape 5 smoothly and efficiently.

Further, because the slope on the flange 15 is formed from a portion in which the mounting shaft 35 of the pull 2 is supported pivotally by the guide post 16 as a starting point, the sliding resistance which the slider body 1 gives the fastener chain 4 is small when the slider is slid by pulling the pull 2 because there exists no protrusion in front of the mounting shaft 35 of the pull 2 in the flange 15, thereby securing a smooth sliding of the slider.

Further, because the guide portion 22 comprising the downgrade slope disposed between flange 15 and the side wall 14 is formed with its longitudinal sectional shape being linear or curved, it is possible to form a slider having an optimum guide portion 22 by taking into account the thickness and material properties of the fastener tape 5.

Further, because the covering plate 32 substantially equal to the contour of the body 1 is disposed on the guide post 16 above the flange 15 with a predetermined interval, the engaging/disengaging operation and the sliding operation can be executed like the ordinary slide fastener of the openable product. Therefore, the effects achieved by the invention are very remarkable.

What is claimed is:

1. A slider for a concealed slide faster, comprising:

a bottom plate;

side walls that are erected on both sides of the bottom plate;

a flange provided by bending a top end of each side wall inwardly; and in the flange at a shoulder opening side, a down-grade slope, which is inclined downward toward the bottom plate at the shoulder opening side, and in each side wall at the shoulder opening side, a down-grade slope, which is continuous to the down-grade slope in the flange and is inclined downward toward the bottom plate at the shoulder opening side.

* * * * *

UNITED STATES PATENT AND TRADEMARK OFFICE

CERTIFICATE OF CORRECTION

PATENT NO. : 7,111,367 B2
APPLICATION NO. : 10/663753
DATED : September 26, 2006
INVENTOR(S) : Keiichi Keyaki and Kenji Yuki It is certified that error appears in the above-identified patent and that said Letters Patent is hereby corrected as shown below:

In claim 1, column 8, line 2, “faster,” should read --fastener,--.

Signed and Sealed this

Twentieth Day of February, 2007

JON W. DUDAS
*Director of the United States Patent and Trademark Office*